US005969675A

United States Patent [19]

Erlick

[11] Patent Number: 5,969,675

[45] Date of Patent: Oct. 19, 1999

[54] METHOD AND SYSTEM FOR BEAMFORMER PRIMARY POWER REDUCTION IN A NOMINALLY-LOADED COMMUNICATIONS NODE

[75] Inventor: John Richard Erlick, Scottsdale, Ariz.

[73] Assignee: Motorola, Inc., Schaumburg, Ill.

[21] Appl. No.: 09/056,130

[22] Filed: Apr. 7, 1998

[51] Int. Cl.[6] ..... H01Q 3/26

[52] U.S. Cl. ..... 342/373; 342/374; 455/277.1

[58] Field of Search ..... 342/372, 373, 342/374; 455/140, 277.1, 12.1, 13.3

[56] References Cited

U.S. PATENT DOCUMENTS

| | | | |
|---|---|---|---|
| 3,879,732 | 4/1975 | Simpson | 343/18 E |
| 5,525,990 | 6/1996 | Lewis | 342/39 |
| 5,589,834 | 12/1996 | Weinberg | 342/354 |
| 5,719,583 | 2/1998 | Kanai | 342/378 |
| 5,812,947 | 9/1998 | Dent | 455/427 |

*Primary Examiner*—Thomas H. Tarcza
*Assistant Examiner*—Dao L. Phan
*Attorney, Agent, or Firm*—Sherry J. Whitney; Frank J. Bogacz

[57] ABSTRACT

A communications node (FIG. 1, 5) communicating with an individual subscriber unit (80) determines that a nominal-load condition exists. The communications node (5) then reduces the number of elements of the transmit and receive phased array antennas (10, 60) used to form receive and transmit communication beams. This reduces the amount of power required by the transmit and receive digital beamformers (15,50) which control the transmit antenna (10) and the receive antenna (60). In order to maintain the radio link with the individual subscriber unit (80), the communications node (5) adjusts the modulation characteristics of the radio link between the communications node (5) and the individual subscriber unit (80). This compensates for the loss of the antenna elements and thus reduces the power consumption of the transmit and receive phased array antennas (10, 60) under nominally-loaded conditions.

22 Claims, 2 Drawing Sheets

FIG. 2
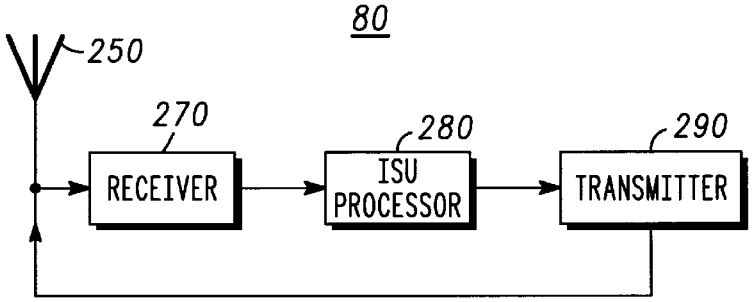
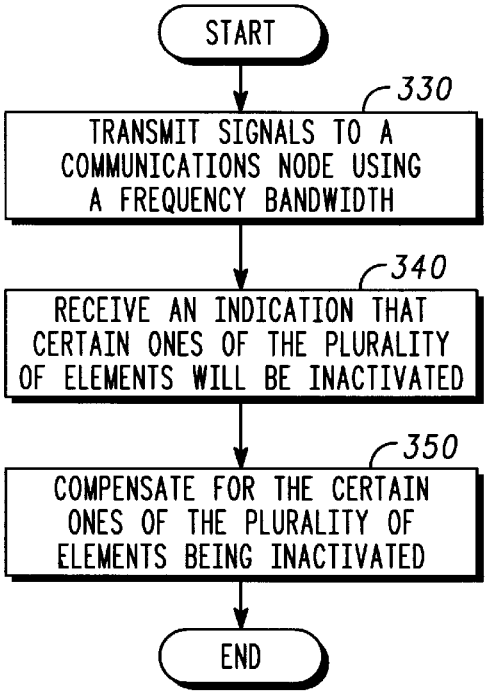
FIG. 4
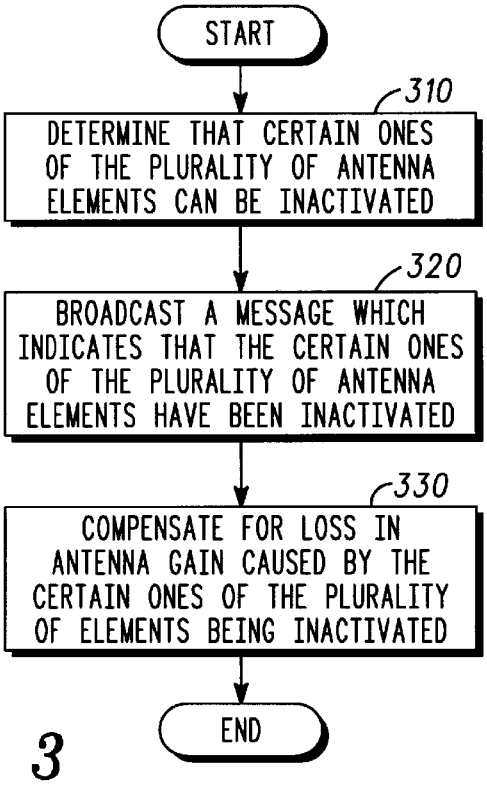
FIG. 3

METHOD AND SYSTEM FOR BEAMFORMER PRIMARY POWER REDUCTION IN A NOMINALLY-LOADED COMMUNICATIONS NODE

FIELD OF THE INVENTION

The invention relates generally to the field of antennas and, more particularly, to the field of digital beamforming.

BACKGROUND OF THE INVENTION

In a radio communication system, in which a communications node establishes and maintains contact with a plurality of subscribers, it is desired to transmit energy to and receive energy from only those areas where subscribers are located. In a space-based communication system, where the communications node is an orbiting satellite, it becomes especially advantageous to control the direction to which receive and transmit antenna beams are pointed due to the need to maximize costly satellite resources. For this reason, in many space-based communication systems, digital beamformers can be used as a flexible means for generating receive and transmit communication beams. The use of a digital beamformer in such a system allows the communications node to generate beams which service subscribers located within specific areas on the Earth's surface and steer these beams as the subscribers move relative to the satellite. Beams can be created and collapsed according to the particular demand on the satellite communications node at any given time. In a low earth orbit satellite system, where the satellite moves with high velocity relative to a terrestrial-based subscriber, a digital beamformer allows subscribers to be tracked within the entire field of view of the communication satellite.

In future space-based communication systems which provide wideband communication services to earth-based subscribers, the antennas used to transmit to and receive signals from the subscribers are expected to require an increasing number of antenna elements. As the number of antenna elements increases, the associated digital beamformer requires a greater amount of primary power in order to generate both transmit and receive antenna beams. Even when a digital beamformer is generating very few transmit or receive antenna beams, the primary power demand can still be quite high. This inability to reduce the power consumption of a digital beamformer operating under nominally-loaded conditions makes size, weight, and cost reductions in the primary power generation system difficult to achieve. Consequently, reductions in the overall operating costs of the communication system are also difficult to achieve.

Therefore, what is needed are a method and system which will enable a communication satellite to reduce primary power required in a digital beamformer operating under nominally-loaded conditions.

BRIEF DESCRIPTION OF THE DRAWINGS

FIG. 2 illustrates a system for beamformer primary power reduction in an individual subscriber unit (ISU) in accordance with a preferred embodiment of the invention;

FIG. 3 illustrates a method for beamformer primary power reduction in a nominally-loaded communications node in accordance with a preferred embodiment of the invention; and FIG. 4 illustrates a method for beamformer primary power reduction in an ISU in accordance with a preferred embodiment of the invention.

DETAILED DESCRIPTION OF THE DRAWINGS

Figure 1:
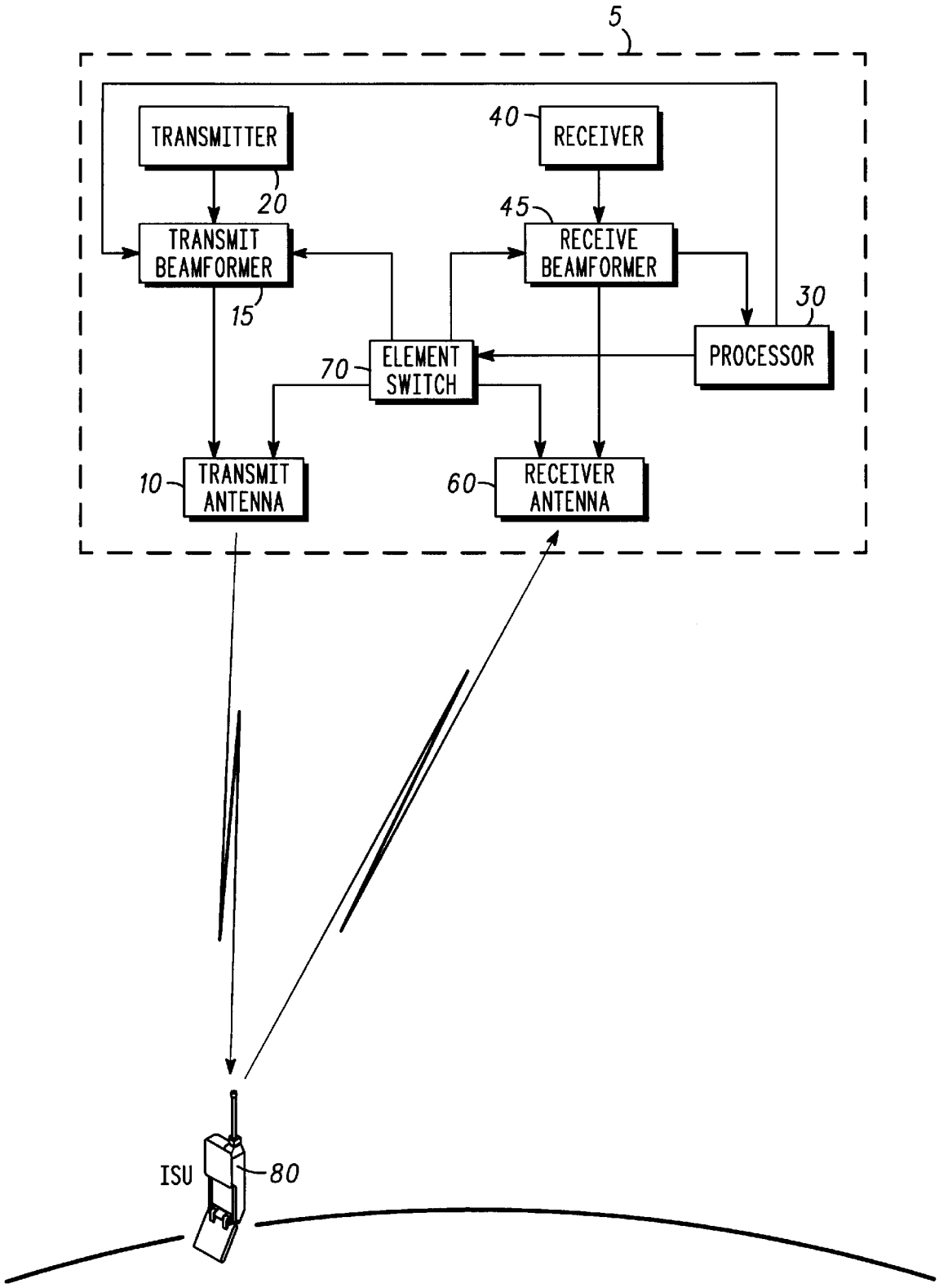
FIG. 1 illustrates a system for beamformer primary power reduction in a nominally-loaded communications node in accordance with a preferred embodiment of the invention.

A method and system for beamformer primary power reduction in a nominally-loaded communications node enables the reduction of the cost and weight of the equipment used to generate and convey power to a digital beamformer. This results in reduced operating costs as well as more efficient communications node operation. When the communications node is an orbiting satellite providing communication services to earth-based subscribers, this results in lower development and deployment costs, as well as greater system life and reliability. Additionally, subscriber units in contact with the communications node do not require additional peak power during transmission.

FIG. 1 illustrates a system for beamformer primary power reduction in a nominally-loaded communications node in accordance with a preferred embodiment of the invention. In FIG. 1, communications node 5 transmits digital data to and receives digital data from individual subscriber unit (ISU) 80. Communications node 5 can be a satellite in either a geostationary or non-geostationary orbit about the earth. Additionally, communications node 5 may make use of crosslinks which interconnect other similar communications nodes to each other and to other networks.

In a preferred embodiment, the radio link between communications node 5 and ISU 80 is a substantially wide band data link capable of conveying digitized audio, digitized video, facsimile, or other information at a given data rate. In a frequency division multiple access system (FDMA) the channel used to couple communications node 5 to ISU 80 is typically of a defined frequency bandwidth assigned by communications node 5 for use during the period in which message traffic exists. Typically, the channel is reassigned for use by another ISU when the message traffic between communications node 5 and ISU 80 has concluded. In another type of system, known as time division multiple access (TDMA), communications between communications node 5 and ISU 80 occur during a predetermined time slot. In yet another types of system, known as code division multiple access (CDMA), communications between communications node 5 and ISU 80 occur using a unique spreading code.

Communications node 5 also comprises transmit antenna 10 which facilitates the transmission of digital data to ISU 80. Transmit antenna 10 desirably comprises a phased array antenna having a plurality of elements which transmit signals which occupy a frequency bandwidth. Each element of transmit antenna 10 can be of any type or construction such as a dipole, monopole above a ground plane, patch, or any other conductive element which radiates an electromagnetic wave as a function of an electrical current present on the surface of the element. Additionally, each radiating element can also be of the aperture type such as a waveguide slot, horn, or any other type of nonconducting element which radiates an electromagnetic wave as a function of the electric field present within an aperture.

The number and the arrangement of the elements which comprise transmit antenna 10 are determined in accordance with the link budget requirements for the one-way path loss from communications node 5 to ISU 80. Generally, this represents an optimization between, among other things, the sensitivity of the receiving components within ISU 80, the radiated power and gain of transmit antenna 10, and the quantity of frequency bandwidth allotted per binary digit of information conveyed from communications node 5 to ISU 80, as well as the rate at which data is conveyed. Thus, for example, if the antenna gain of transmit antenna 10 were to diminish, the frequency bandwidth per binary digit could be allowed to increase by a corresponding amount. The resulting change in the link budget between communications node 5 and ISU 80 could then reasonably be expected to be zero.

In FIG. 1, communications node 5 also comprises receive antenna 60, which receives signals from ISU 80. Receive antenna 60 desirably comprises a phased array antenna having a plurality of elements which receive signals which occupy a portion of the system bandwidth. Receive antenna 60 should be comprised of antenna elements similar to those of transmit antenna 10. (Receive and transmit functions can share other hardware elements within communications node 5 including, but not limited to, filters, oscillators, and other electronics.) The number and the arrangement of the elements which comprise receive antenna 60 are determined by the link budget requirements for the one-way path loss from ISU 80 to communications node 5. The same considerations used to optimize the radio link from communications node 5 to ISU 80 are also used in the optimization of the radio link from ISU 80 back to communications node 5.

Coupled to transmit antenna 10 is transmit beamformer 15. Similarly, receive beamformer 50 is coupled to receive antenna 60. Both transmit beamformer 15 as well as receive beamformer 50 contain the digital signal processing elements required to perform digital beamforming in accordance with conventional techniques. Therefore, each of beamformers 15 and 50 may contain digital signal multipliers, summers, and other components needed to perform digital beamforming of an antenna beam. Typically, each of beamformers 15 and 50 execute digital signal processing for each of the elements which comprise receive antennas 10 and 60, respectively.

Desirably, beamformers 15 and 50 are capable of generating multiple beams with each beam having a distinguishing characteristic. In a preferred embodiment, each beam formed by beamformers 15 and 50 are distinguished by the spatial separation of the beam patterns projected on the surface of the earth.

Communications node 5 also includes message traffic processor 30 which processes and routes data link information and determines the current loading of the communications node. In a preferred embodiment, communications node 5 facilitates the connection of additional ISUs, similar to ISU 80, to a communications network with each ISU being assigned a specific portion of the overall system bandwidth. In an FDMA system, a nominally-loaded condition exists when a substantial portion of the frequency bandwidth within each beam is not being utilized. When this is the case, message traffic processor 30 can determine that the frequency bandwidth assigned to each of the current subscribers can be increased. For example, when it is determined that only ten percent of the available frequency bandwidth is being utilized by subscribers, such as ISU 80, message traffic processor 30 can increase the frequency bandwidth allotted to each subscriber by a factor of ten without requiring additional system bandwidth.

In an alternative embodiment, in which TDMA techniques are used to multiplex subscribers, such as ISU 80, a nominally-loaded condition exists when a substantial portion of these time slots are unused. In yet another embodiment, in which CDMA is used to multiplex subscribers, such as ISU 80, a nominally-loaded condition exists when few of the available codes are in use.

In any case, whether FDMA, TDMA, CDMA, or another modulation type is used, either alone or in combination, a nominally-loaded condition can be determined to exist and methods are available to allow users to consume a greater portion of the system frequency, time, or code processing resources. When a nominally-loaded condition is determined to exist, communications node 5 can use one of several techniques, such as those described above, to enable each subscriber, such as ISU 80 to consume more frequency bandwidth, time slots, or code processing resources. Each of these techniques can result in an increase in the link margin from communications node 5 to subscribers, such as ISU 80.

When message traffic processor 30 determines that additional frequency bandwidth, time slots, or code processing resources can be assigned to subscribers, such as ISU 80, a signaling message which indicates the desired bandwidth, time slot, or code change is broadcast through transmit antenna 10. Additionally, message traffic processor 30 also determines that some of the elements which comprise transmit antenna 10 and receive antenna 60 can be inactivated in order to reduce the primary power consumed by beamformers 15 and 50 and the associated transmit and receive electronics in antennas 10 and 60. For the system illustrated in FIG. 1, element switch 70 controls the mechanism which inactivates certain ones of the plurality of elements of transmit antenna 10 and receive antenna 60 and their associated digital signal processing components within beamformers 15 and 50. As the antenna elements and their associated digital signal processing components are inactivated, it can be expected that the gain characteristics of the beams generated by transmit antenna 10 and receive antenna 60 will suffer some level of degradation. However, in a nominally-loaded communications node, the effects of the degradation in the gain of transmit antenna 10 or receive antenna 60 can be compensated for through the use of increased frequency bandwidth, an additional time slot, or additional code processing resources allotted to each binary digit of information. Additionally, new coefficients can be used in beamformers 15 and 50 to provide an optimized transmit or receive beam given only those antenna elements which are currently active.

The increase in the bandwidth allotted per binary digit can take several forms. In a preferred embodiment in which FDMA is used, for example, an increase in the frequency allotted per binary digit can be facilitated through an increase in the index of modulation. Such an increase can be expected to increase the energy per bit at a receiving end. In an alternate embodiment, in which TDMA is used, a variable rate voice encoder and decoder (vocoder) can be used to decrease the data rate between communications node 5 and ISU 80. Decreasing the data rate of the signals transmitted between communications node 5 and ISU 80 provides a similar increase in the energy per bit at a receiving end. In yet another example, in which CDMA is used, adding a coding layer can be used to decrease the cross correlation between adjacent codes used by subscribers, such as ISU 80. This decrease in cross correlation provides an increase in the energy per bit at a receiving end. Other conventional techniques of increasing the bandwidth, time, or codes allotted per binary digit can be applied to communication systems which make use of different modulation techniques.

In response to the change of state of element switch 70, transmitter 20 subsequently modulates message traffic intended for subscribers, such as ISU 80, using an increased frequency bandwidth (in an FDMA system), an additional time slot (in a TDMA system), or additional code processing resources (in a CDMA system). Similarly, receiver 40 receives and demodulates message traffic from ISU 80 using an increased frequency bandwidth (in an FDMA system), additional time slot (in a TDMA system), or additional code processing resources (in a CDMA system). For the duration of the nominally-loaded condition, as determined by message traffic processor 30, communications node 5 can continue to transmit to and receive from ISU 80 using this low-power mode of operation. This enables communications node 5 to conserve primary power resources without requiring additional system bandwidth.

FIG. 2 illustrates a system for beamformer primary power reduction in an ISU in accordance with a preferred embodiment of the invention. ISU 80 comprises antenna 250, transmit/receive switch 260, receiver 270, ISU processor 280, and transmitter 290. In FIG. 2, received signals from communications node 5 are incident on antenna 250. Although shown as a single element, antenna 250 may include several receiving elements such as antenna 10 as described in reference to FIG. 1.

Receiver 270 is coupled to antenna 250 and provides the demodulation any received signals. Receiver 270 includes the necessary elements required to forward the signaling message indicating a nominally-loaded condition from communications node 5 to ISU processor 280. In a preferred embodiment, in response to receiving this signaling message, ISU processor 280 adjusts the modulation characteristics of receiver 270. ISU processor 280 also adjusts the modulation characteristics of transmitter 290. In response to this adjustment, transmitter 290 then transmits subsequent messages to communications node 5 using these modulation characteristics.

In a preferred embodiment, in which FDMA is used, the frequency bandwidth of receiver 270 is adjusted in accordance with the content of the signaling message. Likewise, ISU processor 280 also adjusts the frequency bandwidth of transmitter 290 by increasing the frequency allotted per binary digit. In this manner, the radio link between ISU 80 and communications node 5 can be maintained without requiring ISU 80 to increase transmit power.

In an alternative embodiment using TDMA, ISU processor 280 adjusts the size of the time slot of receiver 270 in accordance with the signaling message. Likewise, ISU processor 280 also adjusts the time slot of transmitter 290 by decreasing the data rate allotted per binary digit. In a system that uses TDMA, this can provide an increase in the link margin without increasing the peak power output of the ISU battery.

In yet another embodiment using CDMA, ISU processor 280 adjusts the spreading code in accordance with the signaling message. Similarly, ISU processor 280 also adjusts a spreading code used by transmitter 290 to communicate with communications node 5.

FIG. 3 illustrates a method for beamformer primary power reduction in a nominally-loaded communications node in accordance with a preferred embodiment of the invention. In step 310, a processor determines that certain ones of the plurality of elements can be inactivated. In step 320, a transmitter broadcasts a message which indicates that the certain ones of the plurality of antenna elements have been inactivated. In an alternative embodiment, this broadcast indicates that these elements will be deactivated at some future time. In this manner, the communications node and the receiving subscribers, such as an ISU, can remain synchronized at all times.

In step 330, the communications node compensates for the loss in antenna gain caused by the certain ones of the plurality of elements being inactivated. In this step, the beam coefficients of the beamformer are modified and the modulation and demodulation parameters of signals, which are generated and received by the communications node, are adjusted.

FIG. 4 illustrates a method for beamformer primary power reduction in an ISU in accordance with a preferred embodiment of the invention. In step 330, an ISU transmits signals to a communications node using a frequency bandwidth. In step 340, the ISU receives an indication that certain ones of the plurality of elements will be inactivated. In step 350, the ISU compensates for the certain ones of the plurality of elements being inactivated.

A method and system for beamformer primary power reduction in a communication system provides a means for reducing the cost and weight of the equipment used to generate and convey power to a digital beamformer. This results in reduced operating costs as well as more efficient satellite system operation. Additionally, in a nominally-loaded system, no increase in total system bandwidth is required. Further, the use of the method and system allows an ISU to communicate with a satellite without imposing additional demands on the peak power consumed by the ISU. This is especially true in a TDMA system.

Accordingly, it is intended by the appended claims to cover all modifications of the invention that fall within the true spirit and scope of the invention.

What is claimed is:

1. A system for beamformer primary power reduction in a communications node, said communications node comprising a phased array antenna having a plurality of elements which receive signals over a predetermined system bandwidth, said system comprising:

an element switch which inactivates certain ones of the plurality of elements which receive said signals and decreases antenna gain of said phased antenna array;

a transmitter which broadcasts an indication that the certain ones of the plurality of elements which receive said signals have been inactivated, said indication also indicating a loss in antenna gain of said phased array antenna; and a receiver which receives said signals using a bandwidth greater than said predetermined system bandwidth.

2. The system for beamformer primary power reduction in a communications node recited in claim 1, wherein said receiver receives said signals using an additional time slot.

3. The system for beamformer primary power reduction in a communications node recited in claim 1, wherein said receiver receives said signals using additional code processing resources.

4. The system for beamformer primary power reduction in a communications node recited in claim 1, wherein said system comprises a satellite.

5. The system for beamformer primary power reduction in a communications node recited in claim 1, wherein said system additionally comprises a message traffic processor which determines whether a nominally-loaded condition exists.

6. The system for beamformer primary power reduction in a communications node recited in claim 5, wherein said message traffic processor controls said element switch.

7. The system for beamformer primary power reduction in a communications node recited in claim 6, wherein said message traffic processor also controls said receiver.

8. A method for beamformer primary power reduction in a communications node, said communications node comprising a phased array antenna having a plurality of elements which transmit signals, said method comprising:

determining that certain ones of the plurality of elements can be inactivated;

broadcasting a message which indicates that the certain ones of the plurality of elements have been inactivated, said message also indicating a loss in antenna gain of said phased array antenna; and compensating for said loss in antenna gain caused by the certain ones of the plurality of elements being inactivated.

9. The method for beamformer primary power reduction in a communications node recited in claim 8, wherein said determining step additionally comprises determining that a nominally-loaded condition exists at said communications node.

10. The method for beamformer primary power reduction in a communications node recited in claim 8, wherein said compensating step comprises decreasing the data rate of said signals.

11. The method for beamformer primary power reduction in a communications node recited in claim 8, wherein said compensating step comprises adding a coding layer to said signals.

12. The method for beamformer primary power reduction in a communications node recited in claim 8, wherein said compensating step comprises increasing the frequency bandwidth occupied by said signals.

13. The method for beamformer primary power reduction in a communications node recited in claim 12, wherein said compensating step further comprises increasing a frequency allotted per binary digit.

14. A method for beamformer primary power reduction in an individual subscriber unit, said individual subscriber unit being in communication with a communications node, said communications node comprising a phased array antenna having a plurality of elements which receive signals from said individual subscriber unit, said signals being transmitted using a frequency bandwidth, said method comprising the steps of:

transmitting signals to said communications node using said frequency bandwidth;

receiving an indication that certain ones of the plurality of elements will be inactivated, said indication also indicating a loss in antenna gain of said phased array antenna; and compensating for certain ones of the plurality of elements being inactivated.

15. The method for beamformer primary power reduction in an individual subscriber unit recited in claim 14, wherein said compensating step additionally comprises transmitting signals using an increased frequency bandwidth.

16. The method for beamformer primary power reduction in an individual subscriber unit recited in claim 14, wherein said compensating step additionally comprises transmitting signals using a decreased data rate.

17. The method for beamformer primary power reduction in an individual subscriber unit recited in claim 14, wherein said compensating step additionally comprises transmitting signals using an additional coding layer.

18. The method for beamformer primary power reduction in an individual subscriber unit recited in claim 14, wherein said receiving step further comprises receiving a signaling message.

19. A system for beamformer primary power reduction in an individual subscriber unit, said individual subscriber unit being in communication with a communications node, said communications node comprising a phased array antenna having a plurality of elements which receives signals from said individual subscriber unit and a transmitter which transmits signals to said individual subscriber unit, said system comprising:

a receiver which receives an indication that certain ones of the plurality of elements will be inactivated, said indication also indicating a loss in antenna gain of said phased array antenna;

an individual subscriber unit processor coupled to a transmitter which adjusts a modulation characteristic of said receiver; and a transmitter responsive to said individual subscriber unit processor which adjusts said modulation characteristic.

20. The system for beamformer primary power reduction in an individual subscriber unit recited in claim 19, wherein said modulation characteristic is a frequency allotted per binary digit.

21. The system for beamformer primary power reduction in an individual subscriber unit recited in claim 19, wherein said modulation characteristic is a time slot.

22. The system for beamformer primary power reduction in an individual subscriber unit recited in claim 19, wherein said modulation characteristic is a spreading code.

* * * * *